US008025282B2

(12) United States Patent
Cognome Mantovan et al.

(10) Patent No.: US 8,025,282 B2
(45) Date of Patent: Sep. 27, 2011

(54) AUTOMATIC MACHINE FOR THE DEPOSIT AND WITHDRAWAL OF CASH

(75) Inventors: Gastone Cognome Mantovan, Turin (IT); Enrico Cognome Colecchia, Turin (IT)

(73) Assignee: CTS Cashpro S.p.A., Turin (IT)

( * ) Notice: Subject to any disclaimer, the term of this patent is extended or adjusted under 35 U.S.C. 154(b) by 0 days.

(21) Appl. No.: 12/282,007

(22) PCT Filed: Mar. 8, 2007

(86) PCT No.: PCT/EP2007/052198

§ 371 (c)(1), (2), (4) Date: Feb. 25, 2009

(87) PCT Pub. No.: WO2007/101880

PCT Pub. Date: Sep. 13, 2007

(65) Prior Publication Data

US 2009/0322015 A1 Dec. 31, 2009

(30) Foreign Application Priority Data

Mar. 9, 2006 (IT) ..... TO2006A0176

(51) Int. Cl.
*B65H 83/00* (2006.01)

(52) U.S. Cl. ..... 271/3.14; 271/298; 209/534

(58) Field of Classification Search ..... 71/3.14, 71/298; 209/534; 194/205, 206; 902/11, 902/12, 16; 235/379
See application file for complete search history.

(56) References Cited

U.S. PATENT DOCUMENTS

2003/0168307 A1 9/2003 Lundblad
2004/0134839 A1 * 7/2004 Kobayashi et al. ..... 209/534

FOREIGN PATENT DOCUMENTS

EP 1517275 A1 3/2005
EP 1544806 A2 6/2005
WO 2005081194 A1 9/2005

* cited by examiner

*Primary Examiner* — Michael McCullough
(74) *Attorney, Agent, or Firm* — Sughrue Mion, PLLC

(57) ABSTRACT

Automatic machine (26) for the deposit and withdrawal of cash, assisted by operator, comprising an input port (33) for a bundle of banknotes (36), a separating device (37) for the bundle of banknotes, a validation device (38) for banknotes separated from the bundle, an output port (39) and an input/output opening (41) for a recycling store (52). The machine (26) has a structure of compact dimensions for use in a banking workstation and comprises a third transaction port (43), for instance a reject/unfit port, and a moving mechanism actuatable for transporting the banknotes from the input port (33), and through the validation device (38), to the output port (39), or to the reject/unfit port (43), and/or to the input/output opening as function of dispensing of the banknotes.

16 Claims, 11 Drawing Sheets

AUTOMATIC MACHINE FOR THE DEPOSIT AND WITHDRAWAL OF CASH

FIELD OF THE INVENTION

The invention relates to an automatic machine for the deposit and withdrawal of cash, assisted by operator.

More specifically, the invention relates to an automatic machine for the deposit and withdrawal of cash, assisted by operator and associated to a banknote recycling store, and relates, in general to an automatic machine for the handling of banknotes.

BACKGROUND OF THE INVENTION

Machines of this type, known as TCR (Teller Cash Recycler) are used in Banking Institutes as assistance to the tellers to automatize operations of deposit and delivery of banknotes from customers.

The automatic machines currently used for the cash-in and the result of cash are located in the immediate proximity of a banking workstation, or between two banking workstations, often underneath the working plane of the banking workstation. These machines have an input transaction port in which the banknotes received from the teller are inserted in bundle for being separated and to pass to a validation device, an output transaction port and, as recycling store, comprise a safe including a series of recycling boxes. The separated banknotes pass to a validation device, which verifies the authenticity and the denomination thereof: the banknotes recognized as valid are sent to the safe, while the banknotes recognized as not valid are sent to the output port. The output transaction port also receives the banknotes from the recycling store.

An activity typical of the banking environment relates to the validation, the calculation and the preparation of stacks of banknotes to be used for reloading automatic equipments for the withdrawal of banknotes of ATM type. The banknotes for such equipments should respect conditions of recycling regarding the degree of integrity thereof. A genuine banknote is "Fit" if it has a degree of such integrity to respect the conditions of recycling. A genuine banknote is "Unfit", if it is not fit to the conditions of recycling: it has to be retired from the circulation and should be processed apart.

In the European Community, the circulation of the banknotes of the European system is regulated by particular banking Rules given, in detail, by the pamphlet "Recycling European of Banknotes" dated January 2005.

An actual classification divides the banknotes for the deposit and following recycling operation in four categories:

Cat 1(A) unidentified banknotes;

Cat 2(A) false banknotes;

Cat 3(A) suspected banknotes;

Cat 4a(B1) genuine and "Fit" banknotes; and

Cat 4a(B2) genuine but "Unfit" banknotes.

The current TCR machines are not able to verify if the banknotes recognized as genuine have a degree of integrity to respect the "Fit/Unfit" conditions of recycling. Those machines are not of help in the operations of calculation and preparation of stacks of banknotes for ATMs.

Complex systems for the automatic processing and the recycling of banknotes and to classify the banknotes on the basis of examination of the "Fit/Unfit" conditions are also known. Such systems include several boxes, which are programmable to receive, in selective way, different kinds and denominations of banknotes. On the other hand, these systems are of high costs and dimensions and are unsuitable to be use close to a banking workstation.

SUMMARY OF THE INVENTION

An object of the invention is to provide an automatic machine for the deposit and withdrawal of cash, assisted by operator (TCR), which has contained dimensions and cost, of high flexibility for operations of calculation and preparation of stacks with recyclable banknotes, and adapted to recognize and separate banknotes not suited for the recycling and which can be used in a banking workstation, or shared between two banking workstations.

According to the present invention, the automatic machine for the deposit and withdrawal of cash is associated to a banknote recycling store and comprises an input port for bundles of banknotes, a separating device for the bundle, a validation device for the separated banknotes, an output port and an input/output opening regarding the recycling store. Suitably, the machine includes a third transaction port, for instance a reject/unfit port and a moving mechanism for the banknotes, actuatable to transport the banknotes from the input port, through the validation device, to the output port or the reject/unfit port or the input/output opening and, or in alternative, to transport the banknotes from the recycling store to the output port. The machine can also operate for operations, in local, of calculation and discrimination of banknotes "Fit-Unfit", without use of the deposit store.

Another problem of the actual TCRs relates the processing of the forgeries which generally depends on national rules. In Italy, if the banknotes to be deposited include forgeries, the teller which follows the operations of cash should immediately notify the found irregularity to the customers, to hold back the presumed false banknotes, make a record and transmit everything to the competent Authorities, for an official identification of forgery and, further processing.

The automatic machines for the deposit and withdrawal of cash (TCR) assisted by operator, currently on the market, process the "Unfit" banknotes in a way not suitable to the actual rules and do not ensure, to the customers enough tracking, with respect to the presumed false banknotes.

Another object of the invention is to provide an automatic machine for the deposit and withdrawal of cash (TCR), assisted by operator, which has contained dimensions and cost, of high operational flexibility and which can easily process "Unfit" banknotes.

According to another characteristic of the invention, the automatic machine for the handling of banknotes is associated to a banknote recycling store and comprises an input port for banknotes in bundle, a separating device, a validation device, an input/output opening regarding the recycling store and an output port for the banknotes, with substantially vertical arrangement of the banknotes and support on the longer edge. In detail, the machine comprises: a moving mechanism including a longitudinal transport group to move the banknotes along the longer dimension, a transversal transport group to move the banknotes along the narrow dimension and a switch group to deviate the banknotes between the path along the longer dimension and the path along the narrow dimension and to make the banknotes to prosecute along the longer dimension. The separating device and the longitudinal transport group are pre-set and are actuatable to separate and move the banknotes along the longer dimension from the input port to the validation device and from the output from the validation device toward the switch group and from the switch group to a third transaction port, for instance a reject/unfit port. By turns, the transversal transport group is pre-set and is actuatable to move the banknotes along the narrow dimension from the switch group to the input/output opening regarding the recycling store and from the input/output opening to the switch group and to the output port.

BRIEF DESCRIPTION OF THE DRAWINGS

The characteristics of the invention will become clear from the following description given purely by way of non-limiting example, with reference to the appended drawings in which.

DETAILED DESCRIPTION OF THE PREFERRED EMBODIMENTS

Figure 1:
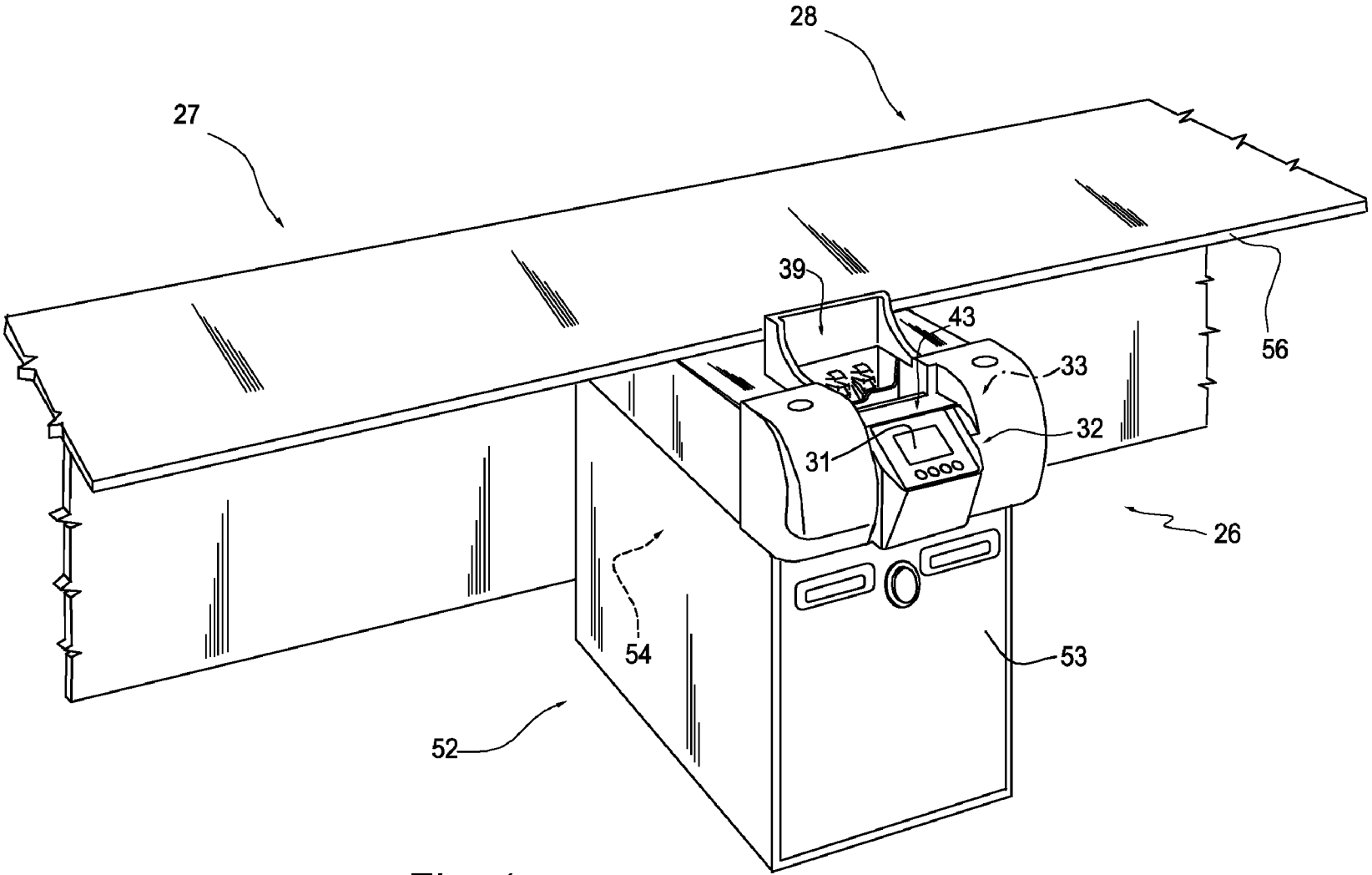
FIG. 1 represents a perspective view of unit an automatic machine for the deposit and withdrawal of cash according to the invention, in a condition of use.
Figure 2:
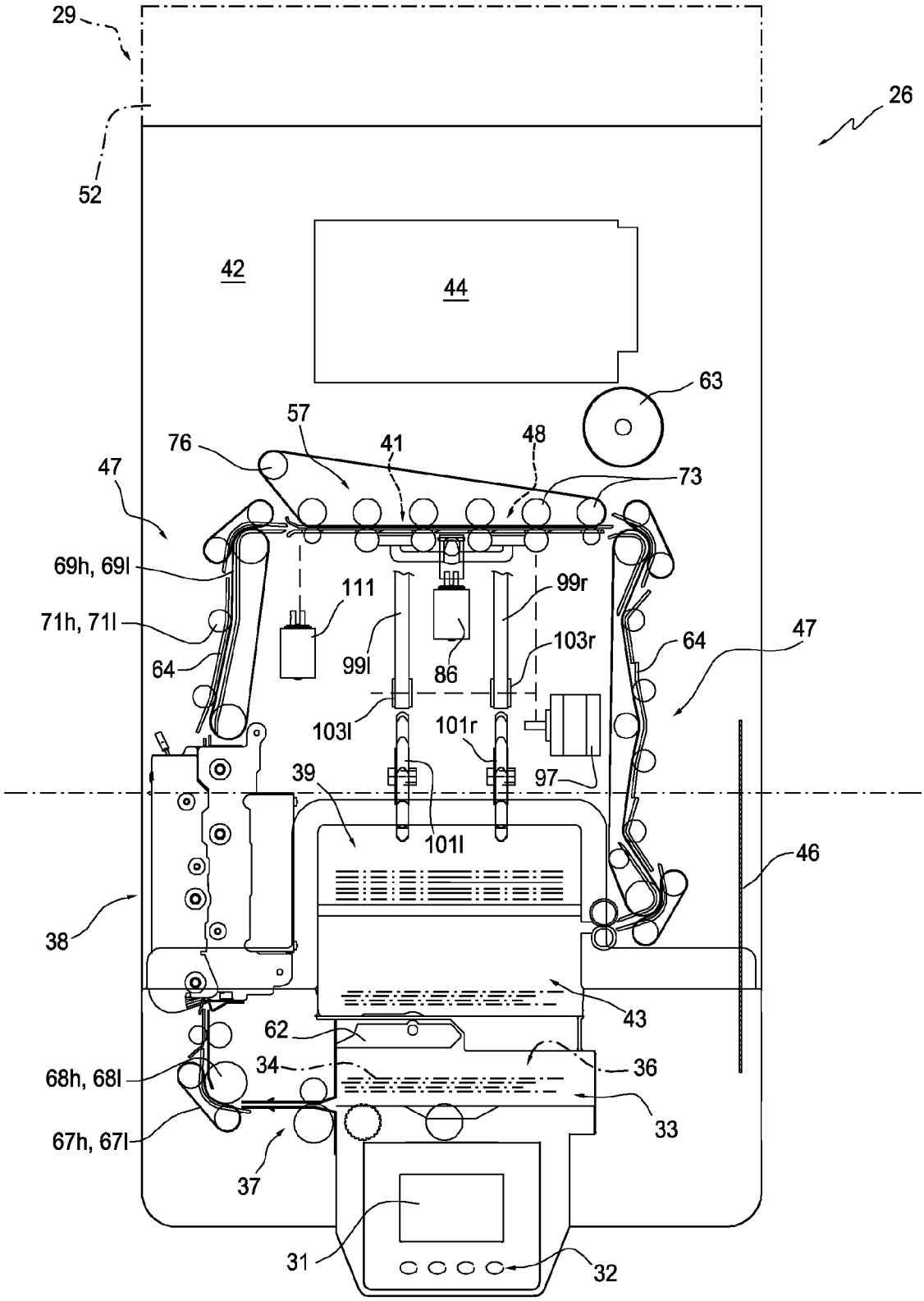
FIG. 2 is a schematic view from the upper, of the machine according to the invention.
Figure 3:
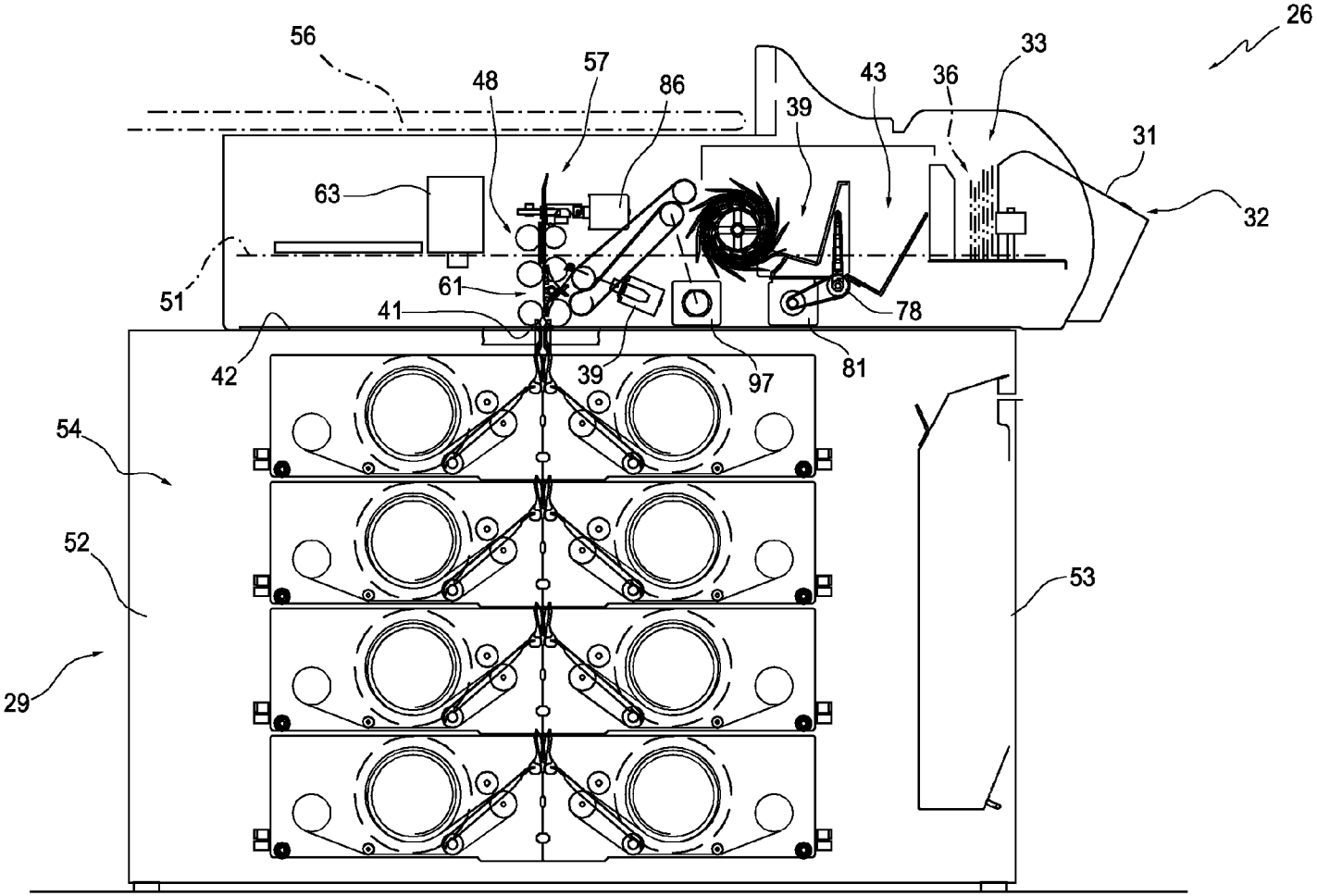
FIG. 3 shows a schematic section of the machine of FIG. 1.

With reference to the FIGS. 1, 2 and 3, an automatic machine for the deposit and withdrawal of cash or, in general, for the deposit and/or the withdrawal of banknotes is represented with 26. The machine 26 is provided for a banking workstation 27 or for the banking workstation 27 and for a second workstation 28 and it is associated with a banknote recycling store 29. As interface with the user, the machine 26 has a "touch screen" 31 and programming and control keys 32, arranged in a front portion of the machine.

The automatic machine 26 comprises an input transaction port 33 for banknotes 34 of a bundle 36, a separating device 37 for the bundle 36, a validation device 38 for the separated banknotes, an output transaction port 39 and an input/output opening 41. The machine 26 has a base 42 bearing on the recycling store 29 and on which is defined the opening 41, of communication with the store 29.

According to the invention, the machine 26 has a general structure of reduced dimensions, having a substantially parallelepiped shape with limited height, and comprises a third transaction port, for instance a reject/unfit transaction port 43, a moving mechanism for the banknotes, a power supply group 44 and an electronic processing unit 46. The moving mechanism is actuatable to transport, in programmed way, the banknotes 34 from the input port to the output port or to the third reject/unfit port or to the input/output opening. Moreover, or in alternative, the machine 26 can transport the banknotes from the recycling store to the output port. Further, the machine can be connected with the banking system, through interface circuits not shown in the figures.

The banknotes 34 have in the transaction ports 33, 39 and 43 a substantially vertical arrangement with support on the longer edge. The moving mechanism includes a longitudinal transport group 47, a transversal transport group 48 and a switch group 49. The longitudinal transport group 47 and the transversal transport group 48 are pre-set to move the banknotes along the longer dimension and, respectively, along the narrow dimension, while the switch group 49 is pre-set to deviate the banknotes 34 between the path along the longer dimension and the path along the narrow dimension.

The separating device 37 and the longitudinal transport group 47 are pre-set to separate and move the banknotes along the narrow dimension from the input port 33 to the validation device 38 and to the output from the device 38 toward the switch group 49. In this shifting, the banknotes are moved horizontally with the lower edges maintained on a same level 51, in proximity of the base 42.

The validation device 38 includes modules for different kinds of validation and based on different physical characteristics, for revealing the authenticity of the banknotes and identify their denomination. The modules are also provided to recognize the degree of wear and classify the banknotes as "Fit" or "Unfit" and according to banking rules of the European Community. In the case of suspected forgeries or in the case of unidentification, the device 38 is adapted to supply illustrative details of these items, known as electronic "Finger printing", shown in the screen 31, for the identification of the false banknote or the unidentified banknote among the other banknotes.

The transversal transport group 48 is pre-set to move the banknotes 34 along the narrow dimensions and in height with respect to the level 51, from the switch group 49 to the input/output opening 41 and to the output port 39 and, moreover, from the opening 41 to the output port 39.

As non limitative example, the machine 26 has, approximately, a width of 50 cm, height of 20 cm and depth of 80 cm, similar to the dimensions of a commercially distributed TCR machine with two transaction ports. The recycling store 29 includes a safe 52, which constitutes the support for the machine 26 and having a same width, a height of about 50 cm and a depth of about 70 cm.

An upper portion of the safe 52 includes a passage slit, which is arranged in a median position in longitudinal sense of the safe. In the use, the passage slit is coupled with the input/output opening 41 of the superimposed machine 26.

The safe 52 has a front vane with a door 53 provided of a lock and lodges recycling boxes 54 for banknotes deposited and to be delivered and a deposit box 55 for the only deposit of banknotes. The boxes 54 are arranged in more levels, mounted on guides in a slidable way and have possibility of removal through the vane of the safe. The boxes 54 and 55 are, for instance, of the type described in the Italian patent N. 1.285.273 assigned to CTS Cashpro SpA. For machines suitable for the Euro system, the safe can include seven boxes 54, for the deposit and the delivery of the corresponding denominations of the system.

The height and the dimensions of the machine 26 are such that the unit constituted by the machine 26 and the safe 52 can be easily arranged under the working plane 56 of a desk in the banking workstation 27 and/or between the two workstations 27 and 28, and in which the portions of interface of the machine project of a little from the front of the safe 52.

In the automatic machine 26, the input port 33, the reject/unfit port 43, the output port 39 and the input/output opening 41 are arranged one behind the other, in a plan view (FIG. 2) and in the longitudinal sense of the machine. The transaction ports have substantially vertical walls and access from the upper for insertion or extraction of the banknotes along the narrow dimension. The transaction port 33 is adjacent to the touch screen 31, while the validation device 38, in the plan view, is arranged at a side of the transaction port 39 and 41, at the left in FIG. 2. The switch group 49 is arranged behind the transaction port 39 in a switching station 57 and the input/output opening 41 is underneath the station 57.

The longitudinal transport group 47 is pre-set to move the banknotes along a horizontal path, substantially encircling the output port 39. This path includes: an initial section between the separating device 37 and the validation device 38, a second section, substantially parallel to a longitudinal axis of the machine, at the output from the device 38, a third section, substantially perpendicular to the longitudinal shaft, which crosses the switching station 57, a fourth section, also substantially parallel to the longitudinal axis, directed to the reject/unfit port 43 and a final section of input for the transaction port 43.

The transversal transport group 48 (FIG. 8) operates between the switching station 57 and the input/output opening 41 and between the switching station 57 and the output port 39. In detail, the group 48 moves the banknotes along a vertical movement surface 58 perpendicular to the longitudinal axis of the machine, and along an inclined movement surface 59. Moreover, the group of transport 48 includes a switching block 61 to deviate the banknotes from the vertical surface 58 to the inclined surface 59.

The vertical surface 58 crosses the input/output opening 41 and relates to direct movements in height of the banknotes 34 between the switching station 57 and the input/output opening 41 through the switching block 61. The inclined surface 59 is salient toward the anterior and relates to movements of the banknotes, along the narrow dimension, from the switching block 61, underneath the level 51, to an upper section of the output port 39.

In the configuration of FIG. 1, with the machine 26 underneath the plane 56, the input port, the reject/unfit port and the output port project from the front edge of the working plane, with easy accesses for the operators of the workstations 27 and 28.

The separating device 37, of known type and not described, has a pushing plate 62 lodged in the transaction port 33 and a functional unit: pre-separation roller, extraction roller and reject roller, which operates on the bundle 36 against a front wall and adjacent to a lateral opening of the transaction port 33, at the left in FIG. 2. The device 37 is actuated by a separation motor, not shown in the drawings, controlled by the electronic processing unit 46.

The longitudinal transport group 47 comprises, as for the initial section of the horizontal path, the second and the fourth section and the final section of the path, pairs of transport belts arranged at different heights and correspondents groups of pairs of contrast rollers, for engaging in height and beginning from the level 51, the various denominations of banknotes, according to a known technique.

Figure 5:
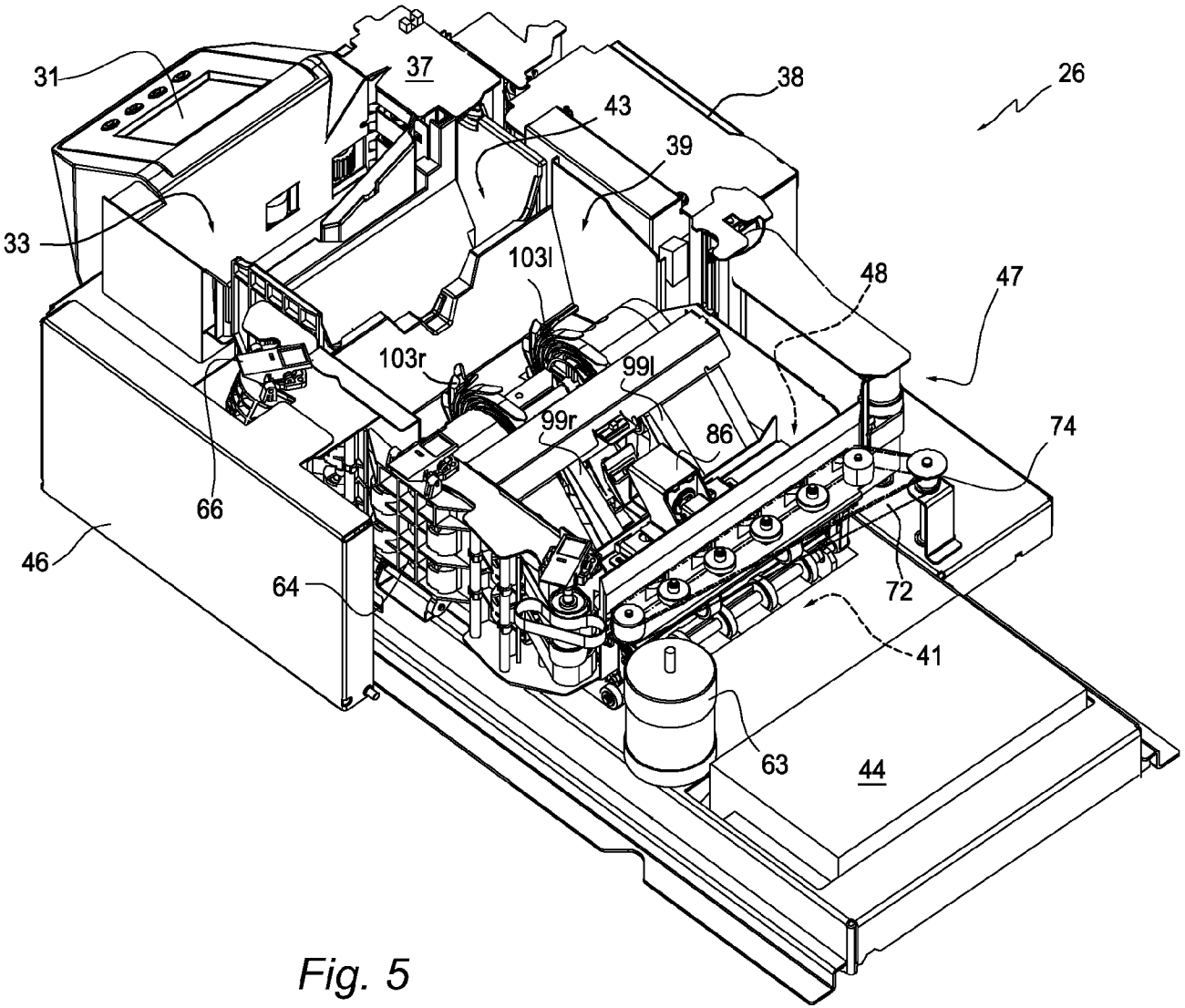
FIG. 5 schematically represents a partial back view of the machine of the invention.
Figure 6:
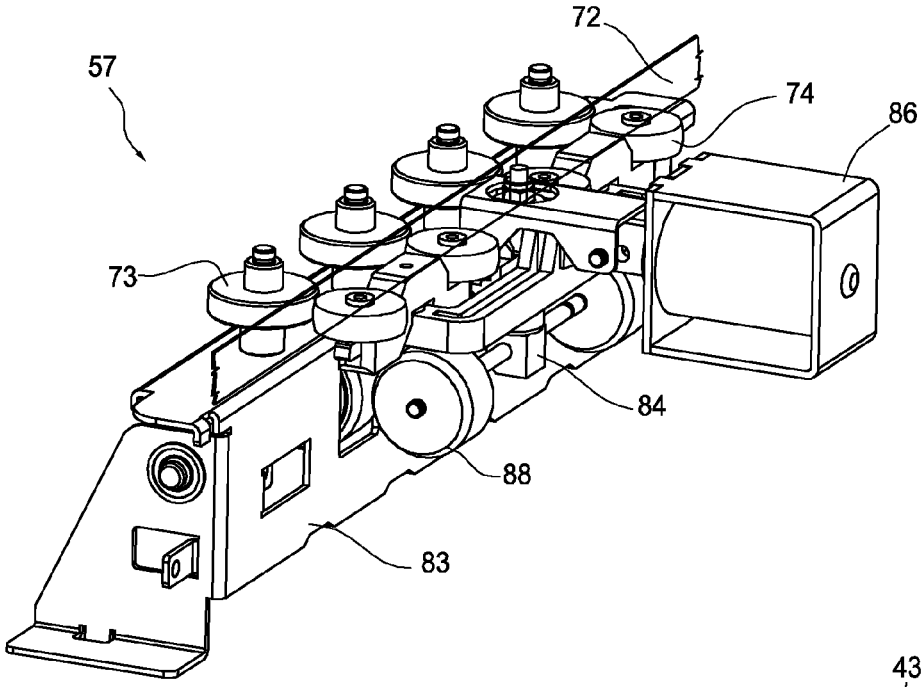
FIG. 6 is a schematic view, in enlarged scale, of some component ones of the machine of FIG. 4.

The transport belts are coupled with support pulleys and motor pulleys rotatable on vertical shafts, and in which the motor pulleys are actuated, in synchronous way, by a horizontal transport motor 63 through transmission members not shown in the drawings. The contrast rollers are also supported by vertical shafts and oppose a branch of the transport belts to guide with precision the banknotes in their horizontal motion, with maintenance of the vertical arrangement. For the longitudinal sections of the path, guiding plates 64, of support for the contrast rollers, are also provided. The plates 64 can be spaced away from the transport belts to eliminate possible jams and can be locked by means of hooks 66 (FIG. 5).

Figure 4:
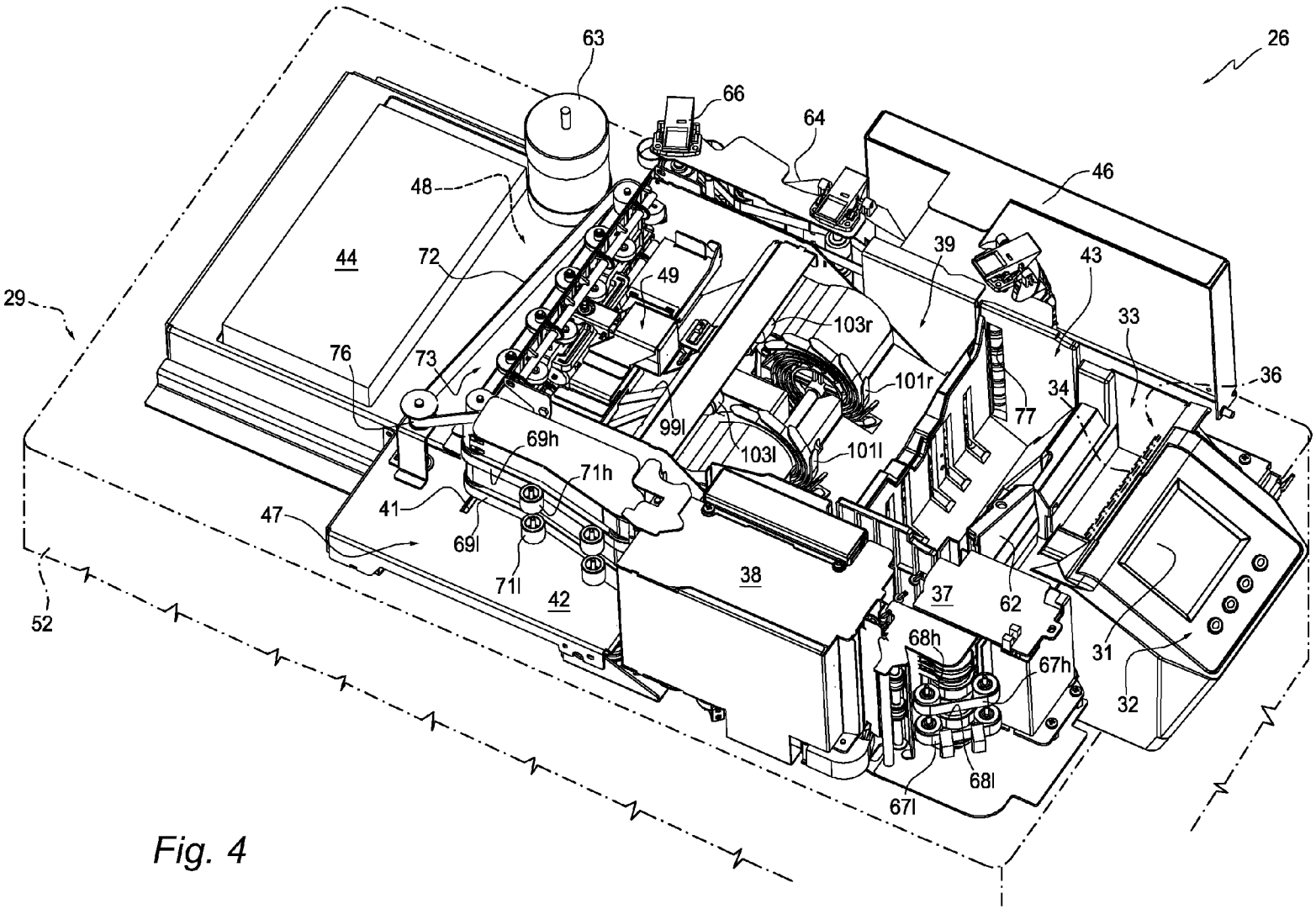
FIG. 4 schematically represents a partial front view of the machine according to the invention.

In FIG. 4 are in evidence belts **67*h* and 67*l* with rollers 68*h* and 68*l* of the group 47 for the initial sections of the horizontal path and transport belts 69*h* and 69*l* with contrast rollers 71*h* and 71*l* for the second section of this path. For the third section of the horizontal path, (FIGS. 4, 5, 6 and 8), in correspondence of the switching station 57, the longitudinal transport group 47 includes a single transport belt 72 coupled to a line of support pulleys 73 and a line of contrast rollers 74. The belt 72 is put in movement by a motor pulley 76, also actuated by the transport motor 63, in synchronism with the other motor pulleys of the group 47**.

For the fourth section of the horizontal path and the final section of the path, other pairs of transport belts and pairs of contrast rollers are provided. FIG. 5 shows the guiding plates 64 and the hooks 66 of these belts and rollers. The final section of the horizontal path ends in a vertical slit 77 of access to the rejection/unfit port 43.

Figure 7:
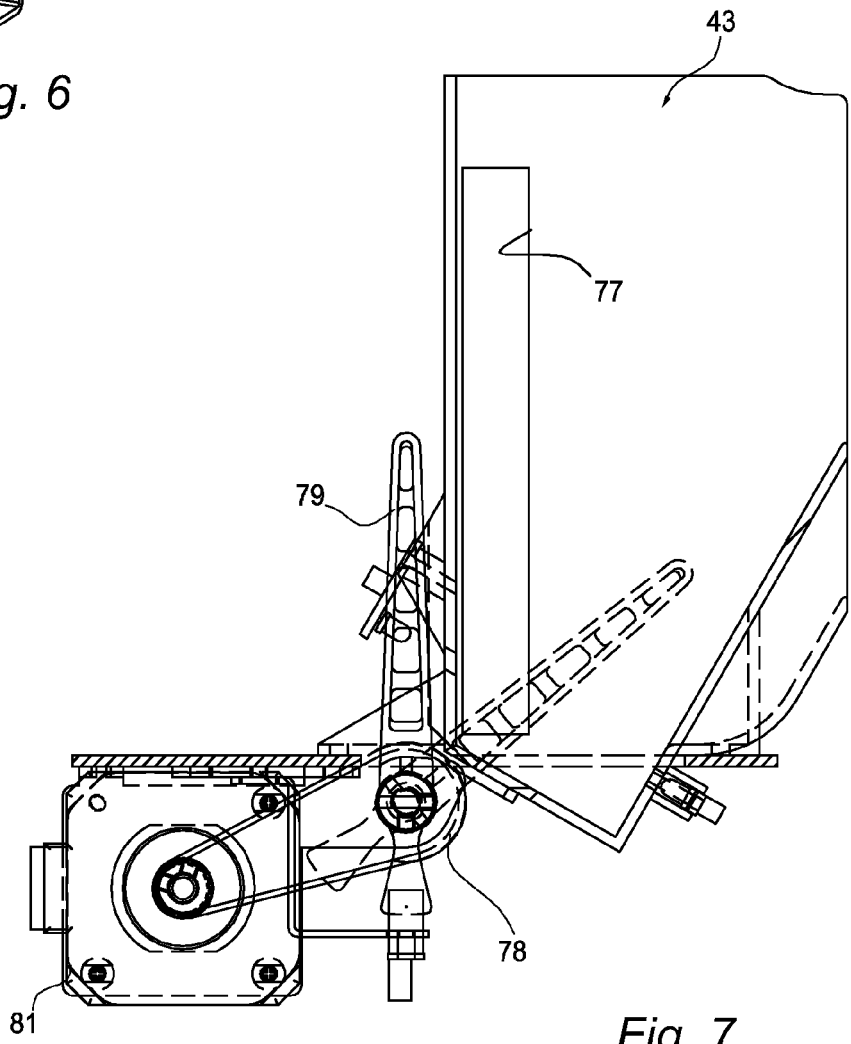
FIG. 7 is a schematic section any component of FIG. 4.

Underneath the transaction port 43 (FIG. 7), a pressure element 78 is fulcrumed in oscillating way. This pressure element 78 has prongs 79 projecting from the bottom and from a back wall of the transaction port 43, both suitable slotted. The pressure element 78 is actuatable between a position of rest, substantially vertical (drawn in continuous line) and an operational position, inclined toward the anterior (drawn in dashed line). In the rest position, the prongs 79 leave a space suitable for the passage of the banknote entering from the slit 77. In the operative position, the prongs 79 press against the banknotes lodged in the transaction port 43, maintaining compacted, against a front wall, the banknotes of the stack in formation.

The pressure element 78 is actuated by a motor 81 and the machine 26 provides sensing elements, not shown in the drawings, responsive to the passage of a banknote directed toward the reject/unfit port 43 to verify the actuation of the motor 81 and, therefore, of the pressure element 78.

The switching station 57 (FIG. 8) defines, parallel to the movement surface 58, a vertical guiding plate 82 and a counter-plate 83, shorter than the plate 82 and arranged closed to the plate 82. The plate 82 and the counter-plate 83 extend upward on level 51, symmetrically with respect to the movement surface 58. In detail, the contrast rollers 74 project through openings of the plate 82, while the belt 72 has an active branch above the counter-plate 83, adjacent to the plate 82.

The switch group 49 includes a support of rocker arm type 84 (FIG. 6) with an upper section on which are mounted, in rotatable way, the contrast rollers 74. The support 84 is operatively connected with a switching electromagnet 86 and is provided for movement between a position of horizontal transport and a position of vertical transport. In condition of electromagnet de-energized and position of horizontal transport, the contrast rollers 74 are in contact with the active branch of the belt 72 for the longitudinal moving of the banknotes. In the position of vertical transport and condition of electromagnet energized, the rollers 74 are spaced away from the belt 72 and the banknotes can move freely between the belt 72 and the rollers 74.

Specifically, the transversal transport group 48 (FIG. 8) comprises, by opposite side with respect to the movement surface 58, motorized rollers 87 projecting from openings of the counter-plate 76 and contrast rollers 88 carried by a lower section of the support 84. Underneath the level 51 and by opposite side with respect to the movement surface 58, the group 48 includes two series of motorized rollers 89 and pinch rollers 91 at a distance from the rollers 87 and 88 such to ensure the contemporary taking of banknotes of smaller height.

The switching block 61 is arranged below and close to the rollers 89 and 91. Underneath the block 61 and, by opposite side with respect to the surface 58, the group 48 includes two further series of motorized rollers 94 and pinch rollers 96. Also the rollers 94 and 96 are close to the rollers 89 and 91 for the contemporary taking of the smaller banknotes directed to the safe or coming from the safe. A vertical transport motor 97 provides to the synchronous actuation of the motorized rollers 87, 89 and 94 through transmission members not shown in the drawings.

For the movement of the banknotes along the inclined surface 59, the transport group 48 includes two pairs of output transport belts 98*l* and 98*r* and two pairs of contrast belts 99*l* and 99*r*. These belts are arranged, side by side, at a distance adapted to engage the different typologies of banknotes and have the active branches adjacent to the surface 59, symmetrically with respect to a median surface of the machine. The lower portions of the belts 98*l*, 98*r* and 99*l*, 99*r* are in front of the switching block 61 underneath the level 51, while the upper portions are close to an upper section of the output port 39.

In the upper section of the transaction port 39, two stacking wheels 101*l* and 101*r*, of known type, are suitably arranged. The stacking wheels have spiral yielding seats to make easier the superimposition of the banknotes transported along the surface 59.

In detail: the transport belts 98*l* and 98*r* are engaged, at a lower part, with support pulleys 102*l*, 102*r* and, at an upper part, with motorized pulleys 103*l*, 103*r*; the contrast belts 99*l* and 99*r* are supported, at a lower part, by pulleys 104*l*, 104*r* and, at an upper part, by pulleys 106*l*, 106*r*. The upper pulleys 103*l*, 103*r* have also tensioning functions for the belts 99*l*, 99*r*, while the lower pulleys 104*l*, 104*r* have tensioning functions for the belts 98*l*, 98*r*.

The motorized pulleys 103*l*, 103*r* and the stacking wheels 101*l* and 101*r* are connected in the rotation with the transport motor 97 through a free wheel mechanism and an inversion gear. This mechanism ensures the unidirectional movement of the pulleys 103*l*, 103*r* and the wheels 101*l* and 101*r* for rotations in opposite direction of the motor 97, and in condition of synchronism with the motorized rollers 87, 89 and 94 of the path along the vertical movement surface 58.

The automatic machine 26 comprises safety devices, herein not described. Further, sensors, for instance photoelectric sensors, recognize the passage of the leading edges of the banknotes through particular areas of the horizontal and vertical paths. Inter alia, passage sensors are provided upstream from the switching station for the longitudinal moving of the banknotes. Other sensors are provided for the transversal movements between the switching station 57 and the switching block 61, between the input/output opening 41 and the block 61 and between the switching block 61 and the belts 98*l,r* and 99*l,r*.

Figure 9:
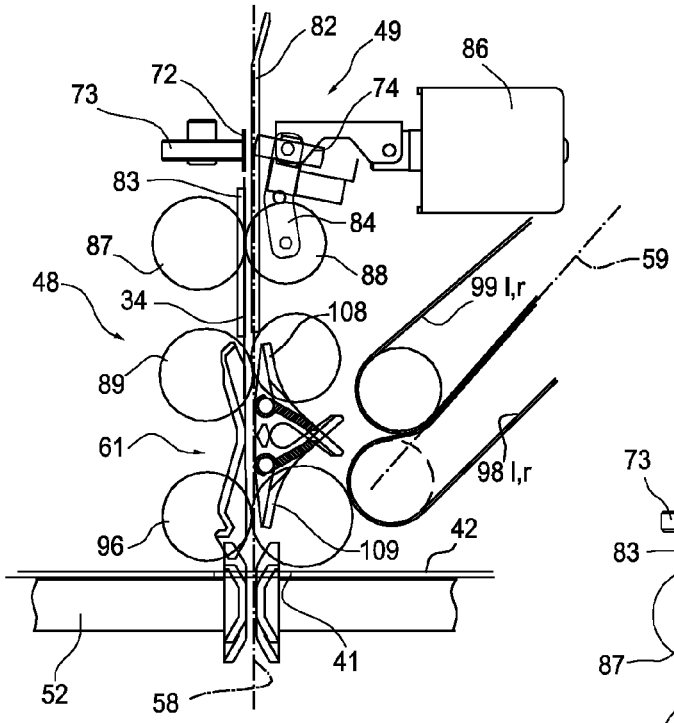
FIGS. 9, 10 and 11 represent the components of FIG. 8, on different operative conditions.
Figure 10:
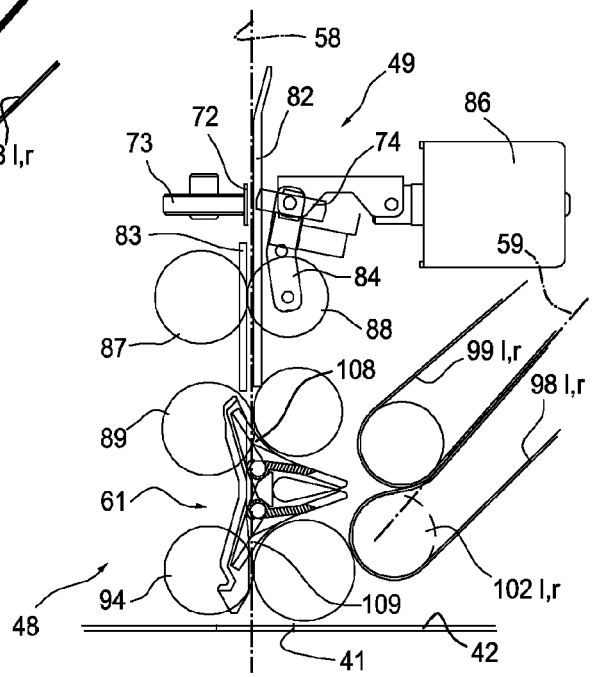
Figure 11:
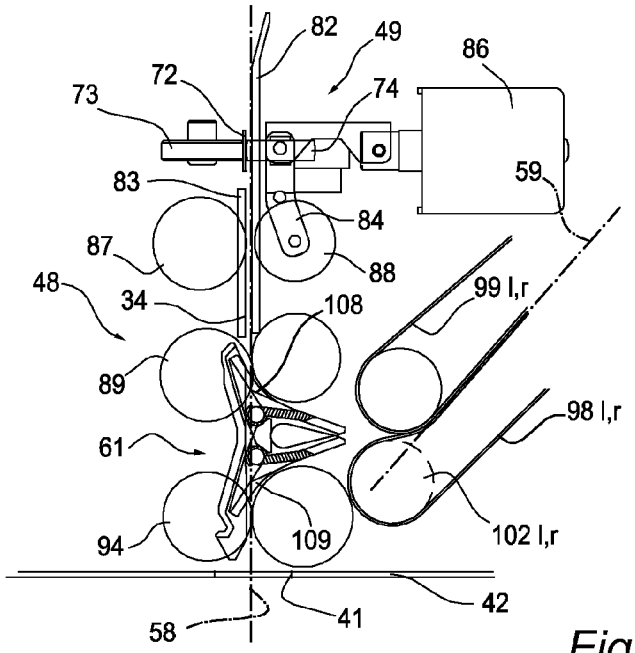
Figure 12:
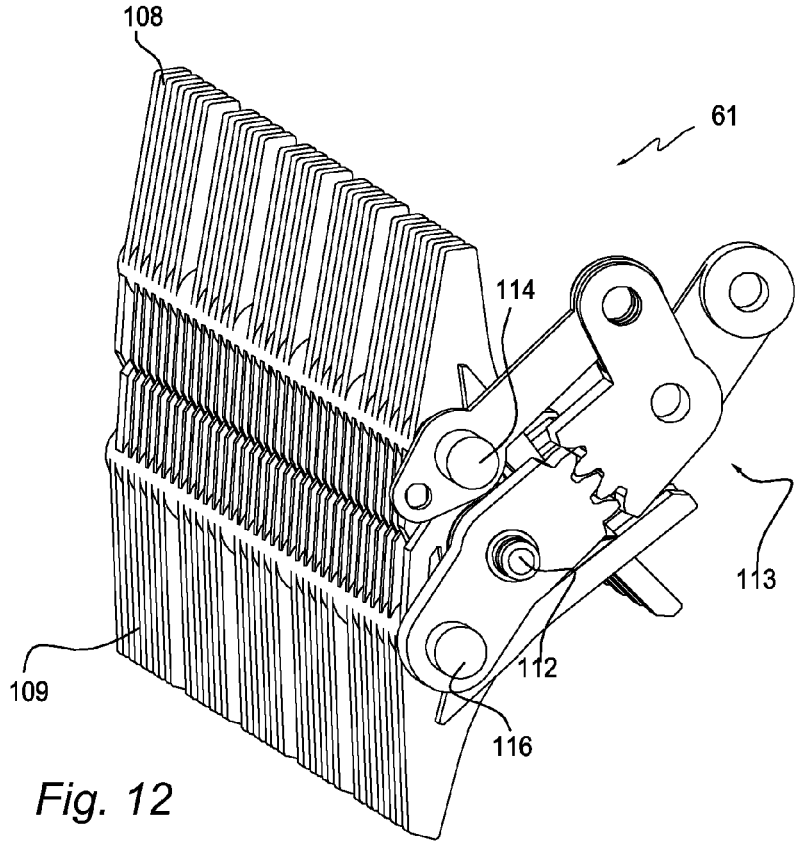
FIGS. 12 and 13 show, in perspective schematic view, some components of the machine of FIG. 3, on two different operative conditions.
Figure 13:
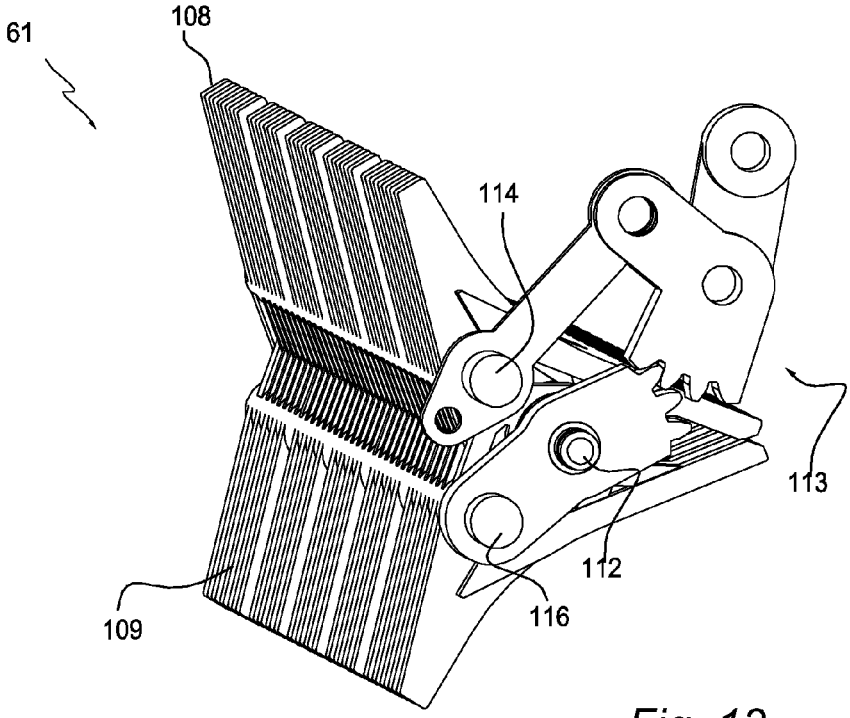

According to the invention, the switching block 61 includes a shaped plate 107, a first diversion element 108, a second diversion element 109 and a diverting electromagnet 111. The plate 107 is arranged in vertical rear the movement surface 58, while the diversion elements 108 and 109 are arranged, with respect to the surface 58, on a half-plane opposite to the one of the plate 107. The elements 108 and 109 have an arched diverting profile delimited by a respective input edge and are actuatable by the electromagnet 111 between a basic position of the FIGS. 8, 9 and 12, and a deviated position of the FIGS. 10, 11 and 13.

The vertical movement surface 58 is conventionally designated as reference path for the banknotes, while the inclined movement surface 59 is designated as deviated path. In the basic position, the diversion element 108 is arranged such that, with respect to the reference path, its input edge is out of the trajectory of a banknote directed in low toward the opening 41 and the banknote can prosecute directly toward the safe 52. In the deviated position, the input edge bears on the plate 107: the diverting profile is on the reference path and deviates the banknote along the deviated path, toward the transport belts 98*l*, 98*r*.

The diversion element 109 is arranged, in symmetrical way, vertically with respect to the element 108 and such that: in the basic position, the element 109 does not interfere with the banknotes in movement along the reference path; in the deviated position, the element 109 deviates the banknotes withdrawn from the safe, in movement along the reference path and directed upwardly.

To this end, when the element 109 is in the basic position, the input edge is out of the movement surface 58 and the banknote can prosecute along the reference path both toward the safe and toward the switching station. In the deviated position, the input edge bears on the plate 107: the diverting profile of the diversion element 109 is crossed by the movement surface 58 and can deviate toward the deviated path the moving banknote withdrawn from the safe.

The diverting profiles and the input edges of the diversion elements 108 and 109 are defined by comb shaped structures: the two elements are interfaced so that the teeth of the diversion element 108 are interposed in the spaces between the teeth of the element 109.

In detail, the diversion elements 108 and 109 are fulcrumed on a common shaft 112 and are connected with the electromagnet 111 through corresponding gear elements 113, which enable a symmetrical and concurrent shifting to the elements 108 and 109. The diverting profiles and the input edges of the diversion elements are identical and are carried by respective mounting shafts 114 and 116 to which the gear elements 113 are connected.

Mode of Operation

The TCR machine of the invention, with the provision of the three transaction ports and the "Fit Unfit" recognizing devices, has large possibilities of programming of the functions and results very flexible in the use. In detail, the machine fully responds to the rules of the European Community on the recycling of the banknotes. The dimensions of the machine remain nevertheless limited and comparable to the dimensions of conventional TCR machines having two transaction ports.

Figure 14:
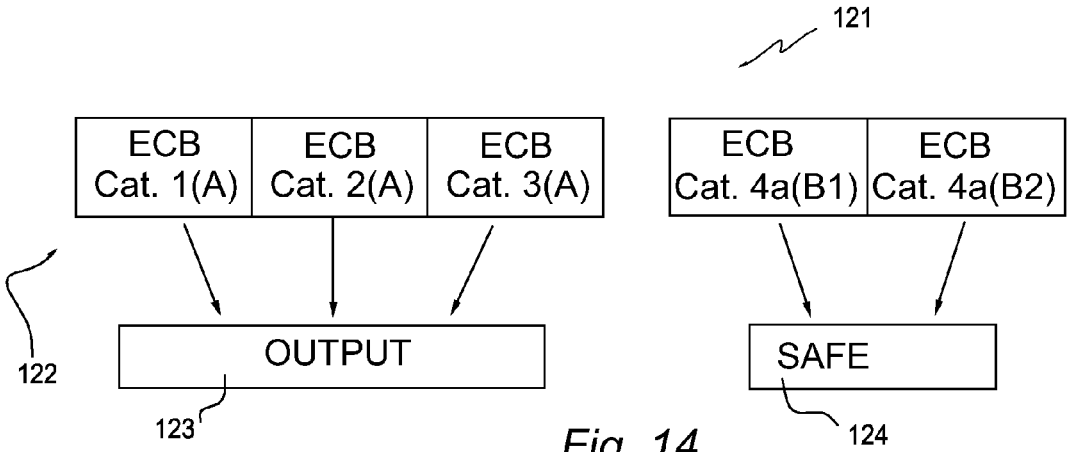
FIG. 14 represents a logical diagram regarding the processing of different kinds of banknotes in a machine of known type.

The mode of operation of a TCR machine 121 of known type is represented in FIG. 14. It is evident that the machine 121 can operate only in function of deposit through an input port 122 and without possibility of control of the "Fit Unfit" condition: The banknotes of Cat 1(A) not recognized, Cat 2(A) false and Cat 3(A), suspected are diverted toward an output port 123. Instead, the banknotes of Cat 4a(B1) genuine and "Fit"; and Cat 4a(B2) genuine but "Unfit" are deposited in the safe 124.

Figure 17:
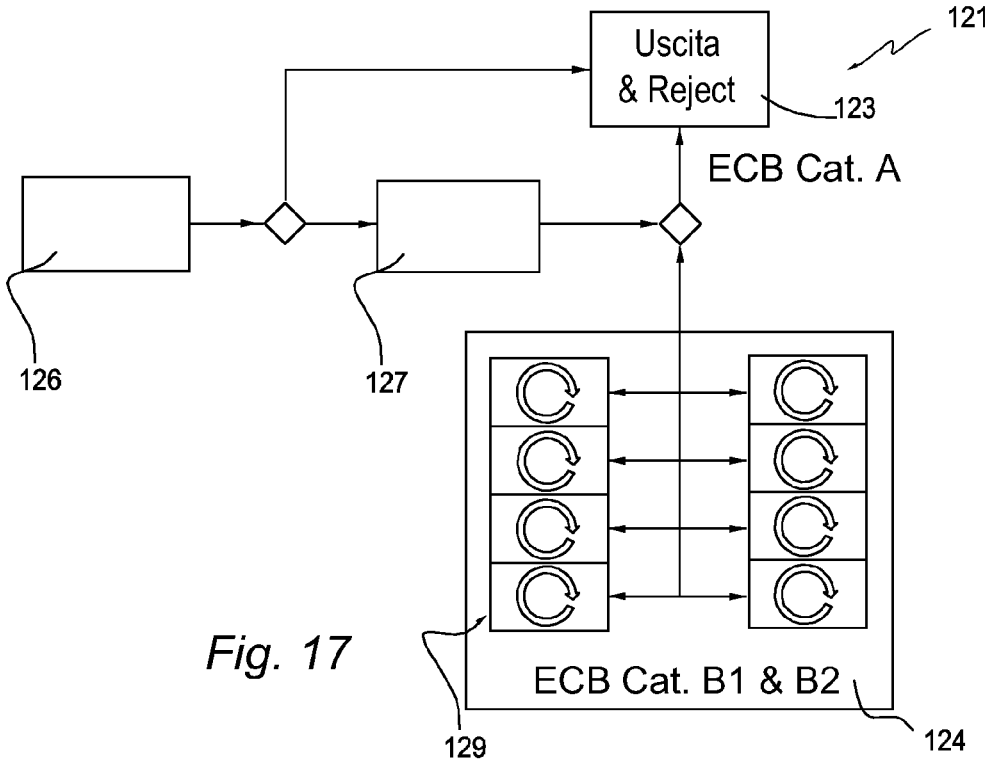
FIG. 17 represents a block diagram regarding the processing of different kinds of banknotes in a machine of known type.

In the known machine 121, according to block diagram of FIG. 17, the banknotes of the bundle 36 are separated in a device 126 and, in case of errors, the separated banknotes are diverted to the output port 123, while the banknotes are normally validated in a device 127. From the validation device, the banknotes of Cat A are diverted to the transaction port 123, and the banknotes of Cat. B1 and Cat B2 are classified by denomination and deposited in the recycling boxes 129 of the safe 124, without any discrimination between the ones "Fit" and the ones "Unfit".

Figure 15:
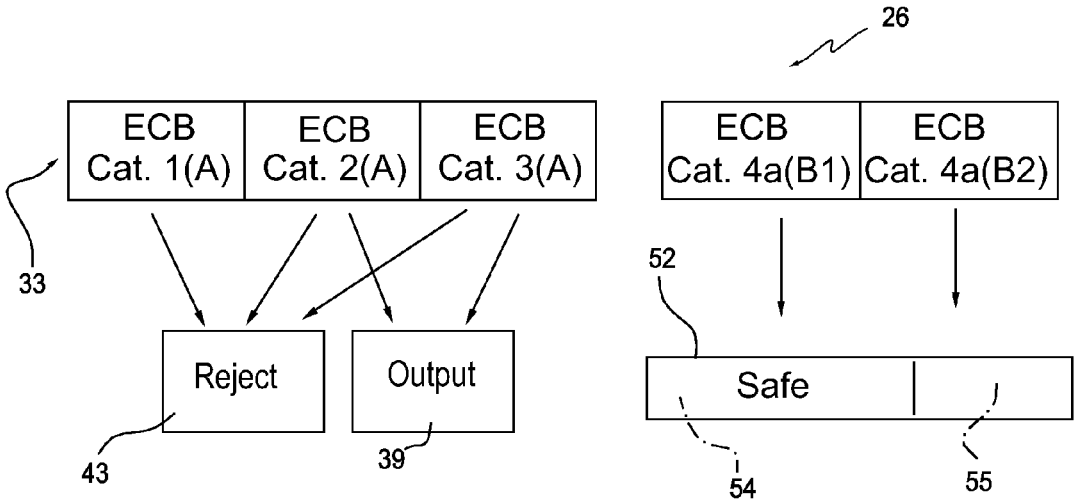
FIGS. 15 and 16 are logical diagrams regarding the processing of different kinds of banknotes and operations in the automatic machine for the deposit and withdrawal of cash according to the invention.

The mode of operation of the machine TCR 26 according to the invention, with respect to the deposit, is represented in FIG. 15. It is put in evidence that the automatic machine 26 can flexibly operate by diverting the banknotes of Cat 1(A) not recognized to the reject/unfit port 43, while the banknotes Cat 2(A) false and Cat 3(A), suspected counterfeits can be diverted toward the output port 39 or toward the reject/unfit port 43. The banknotes of Cat 4a(B1) genuine and "Fit" will be diverted to the recycling boxes 54, while the banknotes Cat 4a(B2) genuine but "Unfit" will be diverted into the only deposit box 55.

Figure 16:
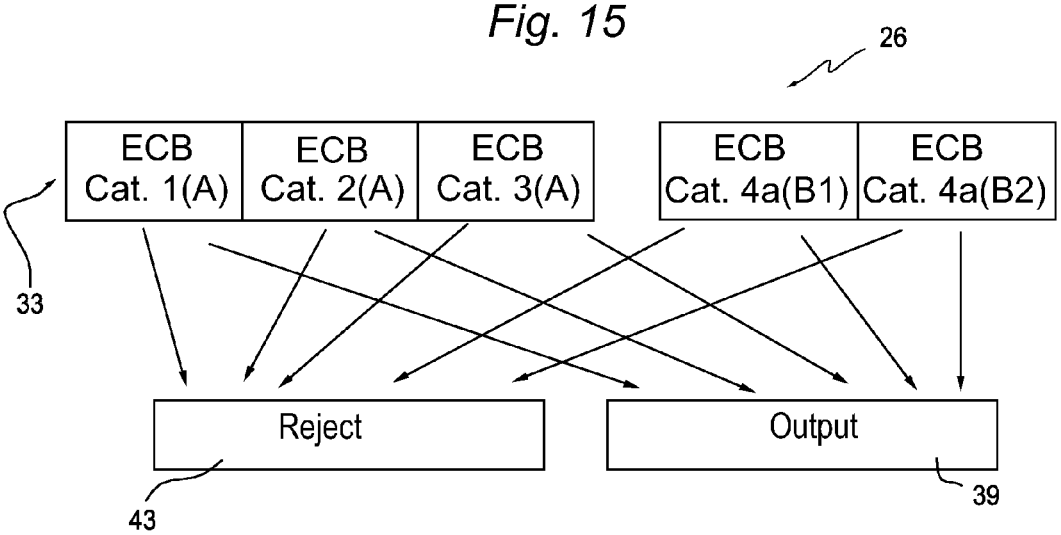

In FIG. 16 is represented the mode of operation of the machine TCR 26 for the calculation and the validation, as function of the preparation of stacks of banknotes to be loaded in ATMs. The machine 26 can flexibly operate by diverting the banknotes of Cat 1(A) not recognized in the reject port 43, while all the other banknotes of Cat 2(A) false, and Cat 3(A), suspected counterfeits can be diverted toward the output port 39 or toward the reject port 43; also the banknotes of Cat 4a(B1) genuine and "Fit"; and of Cat 4a(B2) genuine but "Unfit" can be diverted toward the output port 39 or toward the reject port 43 on the basis of programs.

Figure 18:
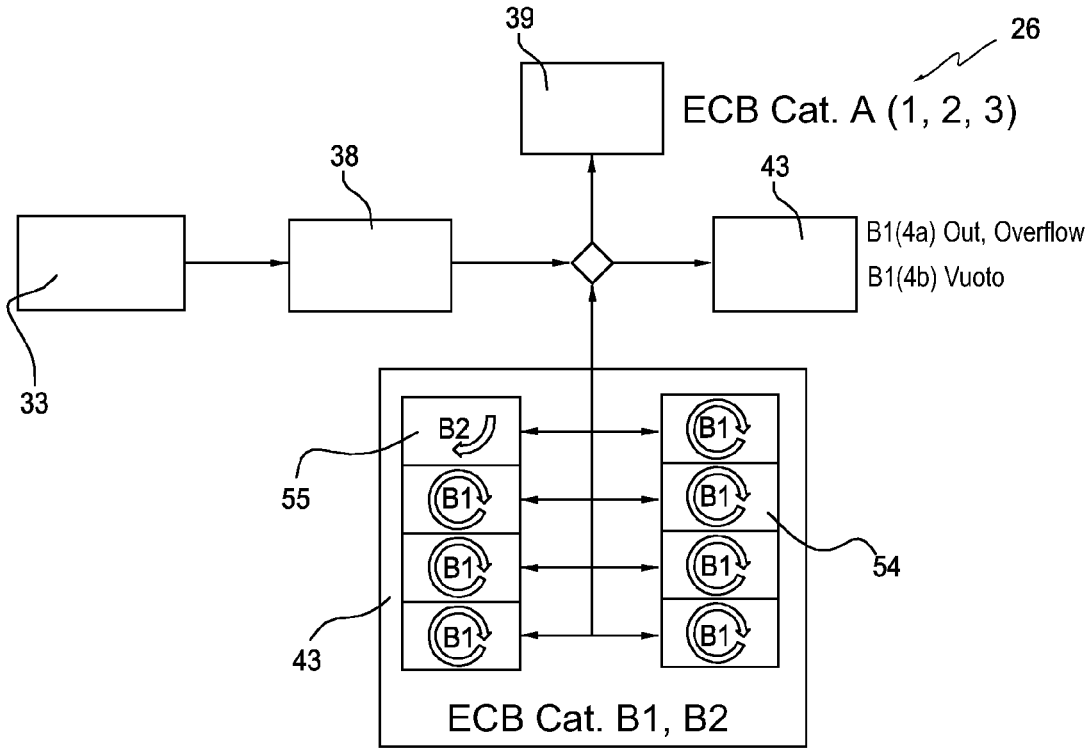
FIG. 18 represents a block diagram regarding the processing of different kinds of banknotes in the automatic machine for the deposit and withdrawal of cash according to the invention.

In the block diagram of FIG. 18, the bundle 36 of the machine 26 are separated in the device 37 and the banknotes pass to the validation device 38. Thereafter, the banknotes are diverted to the reject port, in case of double feeding during the separation from the bundle and of items different from the banknotes, while the banknotes of Cat 1(A) not recognized, Cat 2(A) false and Cat 3(A), suspected counterfeits are diverted to the output port 39. The banknotes of Cat. B1 "Fit", classified by denomination, are deposited into the recycling boxes 54, while the banknotes Cat B2, "Unfit" are deposited into the only deposit box 55.

At the end of the day, the operator can withdraw the "Unfit" banknotes from the box 55, following a withdrawal procedure specific for this operation.

According to a typical procedure of deposit, the machine 26 is preset for transporting the banknotes from the input port 33 to the validation device 38 and to the input/output opening 41 for the deposit in the recycling store 29, after a previous recognition on validity and state of wear. The genuine but unfit banknotes or the items not recognized and the banknotes identified as false or suspected counterfeits are all diverted to the output port 39. The characteristic identifying the false banknotes are shown on the screen 31 for the immediate notification to the customer.

In detail, on control of the operator, the motor of the separating device 37, the motors 63, 97 of the longitudinal transport groups and transversal transport groups start and, with respect to the motor 97, for a sense of rotation of the rollers 87, 89 and 94 directed to an upper-down direction of shifting.

The bundle of banknotes 39 introduced in the transaction port 33 (FIG. 2) is pressed by the plate 62 against the preseparation roller 62. The banknotes 34 are singularly separated in longitudinal sense through the extraction roller and the roller of refusal of the device 37. Then, the banknotes are engaged between the transport belts **67*h* and 67*l* and the contrast rollers 68*h* and 68*l* of the initial section of the horizontal path and pass to the validation device 38. By here, after the reading and the validation, the banknotes pass to the second section and the third section of the horizontal path in the switching station 57**.

If the banknote is authentic and "Fit", upon the passage in front of the sensor, upstream of the switching station 57, the electronic unity 46 activates the switching electromagnet 86 and maintains de-activated the diverting electromagnet 93. The support 84 is moved from the position of horizontal transport of FIG. 8 to the position of vertical transport of FIG. 9 and causes the disengagement of the contrast rollers 76 from the belt 72 and the simultaneous engagement of the contrast rollers 88 with the banknote 34 against the motorized rollers 87.

Thus, the direction of motion of an authentic banknote and "Fit" it changed from the longitudinal sense, in horizontal, to the transversal sense, downward in vertical, along the surface 58. The motion is prosecuted by the rollers 89 and 94, without any interference by the diversion elements 108 and 109 with cross of the input/output opening 41, deposit in one of the recycling boxes 54 and credit of the cash according to the information furnished by the validation device. The procedure is identical for an authentic "Unfit" banknote but, in this case, the banknote is sent in the only deposit box 55.

Figure 8:
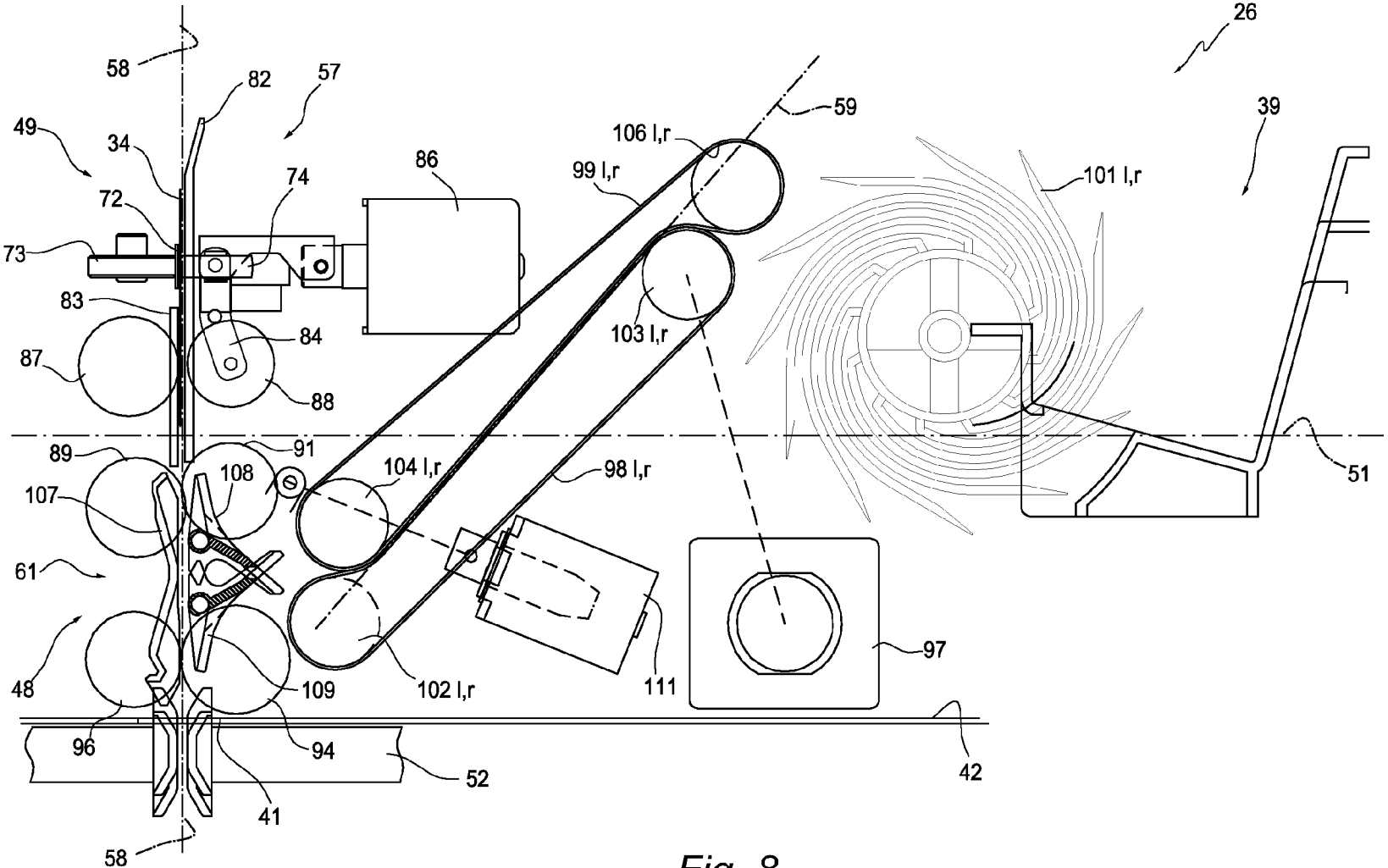
FIG. 8 shows, in schematic section, any component of FIG. 4.

When the unidentifiable items, or the overlapped banknotes pass in front of the sensor upstream of the switching station 57, the electronic unity 46 leaves de-energized the switching electromagnet 86 and maintains the support 84 in the position of horizontal transport of FIG. 8.

The direction of motion does not change and the unidentifiable item or banknote prosecutes the movement in the longitudinal sense, engaged by the belts and the rollers of the fourth section of the horizontal path and by the final section of the path, with input in the reject/unfit port 43 through the slit 77. The electronic unit 46 also provides to synchronous actuate the motor 81 for the opening and the closing of the prongs 79 of the pressure element 78 with easy stacking of the banknotes.

The procedure is identical for a false or suspected counterfeit banknote. However, the electronic unit signals the irregularity, does not cash any credit and shows the "Finger printing" of the banknote. Therefore, the teller can withdraw the banknotes identified as false or suspected counterfeit from the transaction port 39, with separation from the others for an immediate notification to the customer.

At the end of the operations, in the case of deposit of a bundle 36 including all the above-considered typologies of banknotes, the machine 26 credits the total of the authentic banknotes "Fit" and "Unfit". The authentic and "Fit" banknotes are deposited in the recycling boxes 54 of the safe, the "Unfit" banknotes are deposited in the only deposit box 55, while the other items have manually been processed according to the specific banking procedures.

According to another program of deposit, the machine 26 can transport the genuine but unfit banknotes or the tickets not recognized in the reject/unfit port 43, while the banknotes identified as false are separately diverted to the output port 39.

In the configuration of cashing-out, the machine 26 is preset for withdrawing the banknotes from the recycling store 29 and transporting these banknotes from the input/output opening 41 to the output port 39 for withdrawal by the teller.

In detail, on predisposition of the teller, jointly to the control of withdrawal for the banknotes from the safe 52, the vertical transport motor 97 is activated according to a sense of rotation of the rollers 94 for an upward direction of shifting, with simultaneous control of the belts 98*l*, 98*r*, 99*l*, 99*r* for an upward movement. Moreover, the diverting electromagnet 93 is energized, with shifting of the diverting member 92 in the deviated position of FIG. 11.

The rollers 94 and 96 of the mechanism 48 move upward the banknote emergent from the input/output opening 41 with vertical arrangement. However, the diversion elements 109 deviate the banknote toward the belts 98*l*, 98*r*, 99*l*, 99*r* in upward movement, with change of arrangement. The banknote 34 is now dragged upward along the inclined surface 59 in the upper section of the output port 39 to be received by the spiral seats of the stacking wheels 101*l* and 101*r* with easy stacking. The electronic unit will debit the cash and the teller can withdraw the requested banknotes from the transaction port 39.

In the control/counting configuration, the machine 26 is preset for transporting the validated banknotes from the input port 33 to the output port 39. In the case of missed recognition by the validation device, the items will be directed to the reject/unfit. The errors of the separating operations and/or the errors of information regarding unidentifiable banknotes or unfit banknotes make to divert the unidentifiable or unfit banknotes into the reject/unfit port 43. Besides, the addressing of the various typologies of banknotes can be different, by means of suitable programming, in response to specific needs.

If the banknote has been recognized authentic and "Fit", upon its passage in front of the sensor upstream of the switching station 57, the electronic unit 46 activates the switching electromagnet 86 and the diverting electromagnet 111. The support 84 and the switching block 61 are, respectively, moved from the position of horizontal transport and from the basic position of FIG. 8 to the position of vertical transport and deviated position of FIG. 10. The contrast rollers 76 are disengaged from the belt 72, while the contrast rollers 88 engage the banknote 34 against the motorized rollers 87.

Thus, the direction of motion of the banknote changes from the longitudinal sense in horizontal, to the transversal sense, in vertical and downward along the surface 58. The motion is prosecuted by the rollers 89, but the diversion elements 108 deviate the banknote toward the belts 98*l*, 98*r*, 99*l*, 99*r* in upward movement, with change of arrangement. The banknote 34 is now dragged upward along the inclined surface 59 in the upper section of the output port 39. Here, the banknote is received by the spiral seats of the stacking wheels 101*l* and 101*r* for the stacking.

If a false or suspected counterfeits banknote has been identified, or in the case of missed validation, the movement continues as for the deposit with output into the reject port 43 and signalling of the identified forgery.

Owing to the provision of the three transaction ports, the machine 26 is easily programmable to execute diversified operations of assistance to the teller. In the configuration of calculation, the machine is provided to easily execute typical operations which comprise:

1) Calculation of banknotes of different denominations from a bundle of mixed items. The machine 26 separates the banknotes inserted in the input port, recognizes the values, cash-in the values and directs the banknotes of different values "Fit" and "Unfit" to the output port, while the unidentified banknotes, the forgeries and the suspects, which cannot be automatically handled, are sent to the reject/unfit port for a manual handling.

2) Calculation of banknotes of a same denomination from a single denomination bundle. The machine 26 separates the banknotes, recognizes the values, cash-in the values and directs the banknotes of the predetermined denomination "Fit" and "Unfit" to the output port, while the banknotes of other denominations, the unidentified banknotes, the forgeries and the suspects, which cannot be automatically handled, are sent to the reject/unfit port for the manual handling.

3) Calculation of banknotes of different denomination from a bundle of mixed items, with selection "Fit" for ATMs re-loading. The machine 26 separates the banknotes, recognizes the values, cash-in the values and directs to the output port only the banknotes "Fit", while the "Unfit" banknotes, the unidentified items, the forgeries and the suspects, which cannot be automatically handled, are sent to the reject/unfit port for the manual handling.

In analogous way, the machine 26 can be programmed for other operations as:

4) Calculation of banknotes having a sole denomination with selection of the "Fit" condition for ATMs re-loading with recognition of the direct face;

5) Calculation of rejected banknotes with selection of the banknotes which cannot be automatically handled, genuine "Fit" and "Unfit" in the output port and of the forgeries and suspects banknotes in the reject/unfit port 6) Sequential analysis of banknotes, with request of confirmation after each single banknote.

If the reject/unfit port 43 reaches its full capacity, the operation of calculation is suspended up to the removal of the banknotes.

From the above referenced description, it results evident that the presence of the three transaction ports, of the recognizing device for false, genuine, "Fit/Unfit" banknotes and the associated moving mechanisms make the machine TCR of the invention fully complying to the needs of the tellers for all the operations of a banking workstation and for the preparation of stacks of banknotes to be recirculated. Further, the machine ensures to reduce the money held at the teller to a minimum and to make recirculating only the banknotes "Fit" according to the various rules.

Naturally, the principle of the invention remaining the same, the embodiments and the details of construction of the automatic machine for the deposit and withdrawal of cash can be widely varied with respect to what has been described and illustrated, by way of non limitative example, without by this departing from the scope of the present claimed invention.

As an example, the machine TCR of the invention can also operate on-line or in local, without any deposit store for operations typical of calculation and selection of the functions "Fit Unfit."

The invention claimed is:

1. Automatic machine for deposit and withdrawal of cash, in combination with a recycling store, comprising an input port for a bundle of banknotes, a separating device for the bundle of banknotes, a validation device for banknotes separated from the bundle, an input/output opening of communication with the recycling store, an output port, reject/unfit port for receiving and accumulating rejected/unfitted banknotes, a switching station and a moving mechanism actuatable for transporting the banknotes from the input port, through the validation device, to the input/output opening, the reject/unfit port, and the output port and from the input/output opening to the output port, and the input port, the reject/unfit port and the output port are open on top to allow access, wherein:

the input port, the reject/unfit port, the output port and the input/output opening are arranged in succession along a longitudinal direction of the machine, while the validation device, in a plan view, is at a side of the input port;

the output port and the reject/unfit port are provided for forming bundles of banknotes having a substantially vertical arrangement and supported on a side of a longer dimension of the banknotes, and the banknotes of the input port are separated and passed through the separating device by shifting along the longer dimension, and wherein the moving mechanism includes a longitudinal transport group, a transversal transport group, and a switch group on the switching station;

the longitudinal transport group is actuatable for moving the banknotes, along the longer dimension, from the input port, through the validation device, to the switching station and from the switching station to the reject/unfit port;

the transversal transport group is pre-set and actuatable for moving the banknotes, along a narrow dimension of the banknotes, from the switching station to the input/output opening and the output port and from the input/output opening to the switching station and the output port; and the switch group is pre-set for deviating the banknotes between a path along the longer dimension and a path along the narrow dimension.

2. The automatic machine in combination with the recycling store according to claim 1 in combination with a working plane, wherein said machine has a height, for being partially arranged below said working plane, and so that the input port, the reject/unfit port and the output port project from an edge of the working plane.

3. The automatic machine in combination with the recycling store according to claim 1, the automatic machine arranged above the recycling store, wherein the moving mechanism is actuatable to transport banknotes from the recycling store to the output port as a function of dispensing of the banknotes, and wherein the moving mechanism is pre-set and is actuatable to move the banknotes along a narrow dimension, downwardly with respect to an output of the validation device and directed toward the input/output opening and from the input/output opening and upwardly from the input/output opening toward the output port.

4. The automatic machine in combination with the recycling store according to claim 1, further comprising a prong element projecting in the reject/unfit port and actuatable between a position such that the prong element leaves a space for passage of a banknote entering in said reject/unfit port and a position of pressure such that the prong element presses against banknotes lodged in the reject/unfit port.

5. The automatic machine in combination with the recycling store according to claim 1, wherein said machine provides a deposit configuration and is predisposed for transporting the banknotes from the input port to the input/output opening for the deposit in the recycling store, in case of recognition, and for transporting the banknotes from the input port to the fit reject/unfit port in case of refused or unfit banknotes.

6. The automatic machine in combination with the recycling store according to claim 1, wherein said machine provides a control/counting configuration and is predisposed for transporting the banknotes from the input port to the output port or to the reject/unfit port in case of missed recognition of the validation device.

7. The automatic machine in combination with the recycling store according to claim 1, wherein, in case of at least one of wrong separating operation from the bundle, missed recognition information, and unfit banknotes, the not-recognized banknotes or the unfit banknotes are diverted to the reject/unfit port.

8. The automatic machine in combination with the recycling store for the handling of banknotes according to claim 1, wherein said machine provides a configuration of delivery and is predisposed to transport banknotes from the input/output opening to the output port as a function of dispensing.

9. The automatic machine in combination with the recycling store according to claim 1 wherein the moving mechanism comprises a diversion device interposed between the input/output opening and the switching station, wherein the switch group is actuatable for transporting the banknotes received from the validation device either to the diversion device or the reject/unfit port, and wherein the diversion device is actuatable between a basic configuration and a deviated configuration, the basic configuration providing a communication between the switching station and the input/output opening for the transport of the banknotes to the recycling store, while the deviated configuration providing a communication between the switching station and the output port for the transport of the banknotes from the validation device toward the output port, and said deviated configuration also providing a direct communication between the input/output opening and the output port for the transport of the banknotes from the recycling store toward the output port.

10. The automatic machine in combination with the recycling store according to claim 1, wherein the longitudinal transport group is provided for moving the banknotes along a path, around the output port, comprising a first section, through the validation device, substantially parallel to the longitudinal direction, a second section, through the switching station, substantially perpendicular to the longitudinal direction and a third section, directed to the reject/unfit port, substantially parallel to the longitudinal direction of the machine.

11. The automatic machine in combination with the recycling store according to claim 1, wherein the transversal transport group is provided for moving the banknotes along a vertical movement surface perpendicular to a longitudinal axis of the machine and along an inclined movement surface, wherein said transversal transport group includes a switching block for deviating the banknotes from the vertical surface to the inclined surface, the vertical surface crosses the input/output opening and defines the path of the banknotes between the switching station and the input/output opening, and the inclined surface is salient toward the anterior and defines the path of the banknotes, from the switching block to an upper section of the output port.

12. The automatic machine in combination with the recycling store according to claim 1, wherein said machine is provided for executing typical operations which comprise:

a) counting of banknotes of different denominations from a bundle of mixed items, wherein banknotes inserted in the input port are recognized with cash-in of the values and moving the mixed banknotes to the output port for authentic and "Fit" banknotes, while unidentified banknotes, forgeries and suspects, are sent to the reject/unfit port for manual handling;

b) counting of banknotes of a same denomination from a bundle of single denomination, wherein banknotes inserted in the input port are recognized with cash-in of the values and moving the banknotes to the output port for the authentic and "Fit" banknotes of said single denomination, while the banknotes of other denominations, the unidentified banknotes, the forgeries and the suspects are sent to the reject/unfit port for the manual handling; and c) counting of banknotes of different denomination from a bundle of mixed items, with selection of "Fit" banknotes for ATMs re-loading, wherein banknotes inserted in the input port are recognized with cash-in of the values and moving to the output port only banknotes "Fit", while "Unfit" banknotes, the unidentified items, the forgeries and the suspects, are sent to the reject/unfit port for the manual handling.

13. The automatic machine in combination with the recycling store according to claim 1, wherein said machine is provided for executing typical operations which comprise:

a) counting of banknotes having a sole denomination with selection of "Fit" condition for ATMs re-loading with recognition of a direct face of the banknote;

b) counting of rejected banknotes with selection of the banknotes which cannot be automatically handled, authentic "Fit" and "Unfit" to be accumulated in the output port and of forgery and suspect banknotes to be accumulated in the reject/unfit port to be taken out by an operator; and c) sequential analysis of banknotes, with request of confirmation for further processing after the recognition of each single banknote.

14. The automatic machine in combination with the recycling store according to claim 1 further comprising a deviation device defining a reference path and a deviated path, wherein said reference path is of communication of an output of the validation device and the switching station with the input/output opening, while the deviated path is of communication of the input/output opening with the output port, said deviation device includes one diversion element with a diverting profile delimited by an input edge and an actuating member for moving the diversion element, with respect to the reference path, between a basic position and a deviated position, so that, in the basic position, the input edge is out of the reference path and a banknote directed along a given direction toward said one diversion element can proceed along said reference path while, in the deviated position, the input edge is on the reference path along the given direction and the diverting profile deviates the banknote toward the deviated path, said device being pre-set to deviate a banknote in movement along the reference path and in a direction opposite to said given direction.

15. The automatic machine in combination with the recycling store according to claim 14, wherein said deviation device further includes another diversion element with diverting profile delimited by a respective input edge, and wherein said other diversion element is connected with said one diversion element so that, when said one diversion element is in the basic position, the input edge of said other element is out of the reference path and the banknote can proceed along the reference path both in the given direction and in the opposite direction, while, in the position deviated of said one diversion element, the input edge of said other element is on the reference path and the diverting profile can deviate toward the deviated path the banknote in movement along the reference path and in the direction opposite to said given direction.

16. The automatic machine in combination with the recycling store according to claim 1, wherein said transversal transport group is further pre-set and actuatable for moving the banknotes along a path, which, in the transport across the input/output opening, is directed downward with respect to the movement surfaces and for moving the banknotes from the switching station along an upward path and from the upward path to stacking wheels of the output port, and wherein the asset of the banknote changes during the transport toward said stacking wheels.

* * * * *

UNITED STATES PATENT AND TRADEMARK OFFICE

CERTIFICATE OF CORRECTION

PATENT NO. : 8,025,282 B2
APPLICATION NO. : 12/282007
DATED : September 27, 2011
INVENTOR(S) : Gastone Mantovan and Enrico Colecchia It is certified that error appears in the above-identified patent and that said Letters Patent is hereby corrected as shown below:

Title Page, Item (12) "Cognome Mantovan et al." should read --Mantovan et al.--

Title Page, Item (75) Inventors should read --Gastone Mantovan, Turin (IT); Enrico Colecchia, Turin (IT)--

Signed and Sealed this
Sixth Day of March, 2012

David J. Kappos

David J. Kappos
*Director of the United States Patent and Trademark Office*